US009039573B2

(12) United States Patent
Smock et al.

(10) Patent No.: US 9,039,573 B2
(45) Date of Patent: May 26, 2015

(54) WATERFALL PIT TRAMPOLINE

(71) Applicant: TRAMPOLINE PARKS, LLC, Roy, UT (US)

(72) Inventors: Dennis Smock, Grants Pass, OR (US); Val Iverson, Ogden, UT (US); Van Stapley, Mountain Green, UT (US)

(73) Assignee: TRAMPOLINE PARKS, LLC, Roy, UT (US)

( * ) Notice: Subject to any disclaimer, the term of this patent is extended or adjusted under 35 U.S.C. 154(b) by 409 days.

(21) Appl. No.: 13/674,368

(22) Filed: Nov. 12, 2012

(65) Prior Publication Data

US 2014/0135178 A1 May 15, 2014

(51) Int. Cl.

| | |
|---|---|
| ***A63B 21/00*** | (2006.01) |
| ***A63B 5/11*** | (2006.01) |
| ***A63B 6/02*** | (2006.01) |
| *A63B 21/02* | (2006.01) |
| *A63B 21/055* | (2006.01) |

(52) U.S. Cl.

CPC ... *A63B 5/11* (2013.01); *A63B 6/02* (2013.01); *A63B 21/023* (2013.01); *A63B 21/0552* (2013.01)

(58) Field of Classification Search

USPC ..... 482/27, 28, 29

See application file for complete search history.

(56) References Cited

U.S. PATENT DOCUMENTS

| | | | |
|---|---|---|---|
| 3,201,126 | A | 8/1965 | Nissen |
| 3,339,925 | A | 9/1967 | Nissen |
| 3,501,141 | A | 3/1970 | Nissen et al. |
| 4,045,021 | A | 8/1977 | Nissen |
| 4,140,313 | A | 2/1979 | Martin |
| 4,331,229 | A | 5/1982 | Kamm |
| 4,433,838 | A | 2/1984 | Gordon |
| 4,474,369 | A | 10/1984 | Gordon |
| 4,569,515 | A | 2/1986 | Gordon |
| 4,644,892 | A | 2/1987 | Fisher |
| 4,730,826 | A | 3/1988 | Sudmeier |
| 4,824,100 | A | 4/1989 | Hall et al. |
| 5,624,122 | A | 4/1997 | Winkelhorn |
| 5,833,557 | A | 11/1998 | Cole |
| 5,947,870 | A | 9/1999 | Hall et al. |

(Continued)

FOREIGN PATENT DOCUMENTS

| | | |
|---|---|---|
| DE | 199 38 192 A1 | 8/1999 |
| EP | 0 107 456 A1 | 5/1984 |
| EP | 0 765 677 A2 | 4/1997 |

OTHER PUBLICATIONS

Spaceball trampoline game Source: http://web.archive.org/web/20080915045441/http://www.1800-trampoline.com/spaceballtrampolinegame.aspx Archive.org Publication Date: Sep. 15, 2008.

(Continued)

*Primary Examiner* — Jerome w Donnelly

(74) *Attorney, Agent, or Firm* — Workman Nydegger

(57) ABSTRACT

Trampolines and trampoline frames configured to support a rebounding mat that extends from a horizontal plane into a vertical plane that is below the horizontal plane. The trampoline includes a horizontal frame that connects to a first portion of the rebounding mat to hold the mat in a substantially horizontal plane and a vertical frame that connects to a second portion of the rebounding mat to hold the mat in a substantially vertical plane that extends downward from the horizontal plane.

23 Claims, 5 Drawing Sheets

(56) References Cited

U.S. PATENT DOCUMENTS

| | | | | |
|---|---|---|---|---|
| 6,162,061 | A | 12/2000 | Taylor | |
| 6,676,546 | B2 | 1/2004 | Gordon | |
| 6,988,967 | B2 | 1/2006 | Allison | |
| 7,182,704 | B2 | 2/2007 | Levy | |
| 7,762,927 | B1 | 7/2010 | Gordon | |
| 8,323,154 | B1 | 12/2012 | Bolillo | |
| 2007/0010374 | A1 * | 1/2007 | Widich | 482/27 |
| 2009/0258759 | A1 * | 10/2009 | Chen | 482/27 |
| 2013/0310223 | A1 * | 11/2013 | Canales et al. | 482/27 |
| 2014/0005003 | A1 * | 1/2014 | Howell | 482/27 |

OTHER PUBLICATIONS

A double mini trampoline Source: http://commons.wikimedia.org/wiki/File:A_double_mini_trampoline.jpg Publication Date: Nov. 20, 2006.

* cited by examiner

WATERFALL PIT TRAMPOLINE

CROSS-REFERENCE TO RELATED APPLICATIONS

None.

BACKGROUND OF THE INVENTION

1. The Field of the Invention

This invention relates generally to trampolines and trampoline frames. More specifically, this invention relates to "waterfall"-shaped trampolines and trampoline frames configured to support a rebounding mat that extends from a horizontal plane into a vertical plane that is below the horizontal plane.

2. The Relevant Technology

Trampolines have become popular in both competitive and recreational settings involving jumping and/or bouncing into the air. Children and adults alike use trampolines for activities ranging from athletic training and physical therapy to birthday parties and simple leisure. Trampolines can be found in residential yards, athletic and fitness facilities, and commercial businesses that provide trampolines for private and public use.

A traditional trampoline includes a frame that suspends a rebounding mat in a horizontal position above the ground with springs that provide a bouncing effect. The frame is typically made of steel or other metal strong enough to suspend the rebounding mat off the ground while a user jumps on the rebounding mat. A recent trend in trampoline jumping involves the use of a landing area (like a foam or ball pit) close to the trampoline, into or onto which a jumper can land following a jump or bounce on the trampoline.

One disadvantage to using traditional trampolines is the potential for bodily injury caused by coming into contact with the springs and/or surface of the metal trampoline frame when dismounting or jumping into the foam pit, even if the springs and/or frame are covered by a pad. For instance, trampoline users who approach the edge of the rebounding mat in preparation for jumping into the pit may land on the springs and/or frame instead. Jumpers may also fail to completely clear the edge of the trampoline frame and be injured while entering the pit.

Accordingly, there are a number of disadvantages to the use of traditional horizontal trampolines, especially when used in combination with landing areas such as foam or ball pits, into or onto which a user can dismount or land following a fall, jump, or bounce.

BRIEF SUMMARY OF THE INVENTION

Implementations of the present invention overcome or solve one or more of the foregoing or other problems in the art with unique trampolines and trampoline frames. In accordance with some forms of the present invention, the trampolines and trampoline frames are configured to support a rebounding mat that extends from a horizontal plane to a vertical plane that is below the horizontal plane. Specifically, one or more implementations of the present invention include a trampoline frame with a vertical support structure for supporting a horizontal frame that is configured to hold a portion of a rebounding mat in a substantially horizontal plane above a floor. The frame also includes a vertical frame that is configured to hold another portion of the rebounding mat in a substantially vertical plane that extends downward from the horizontal plane.

Another implementation of the present invention includes a trampoline with a rebounding mat connected to a frame. The frame includes a horizontal frame that connects to a first portion of the rebounding mat to hold the mat in a substantially horizontal plane and a vertical frame that connects to a second portion of the rebounding mat to hold the mat in a substantially vertical plane that extends downward from the horizontal plane.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
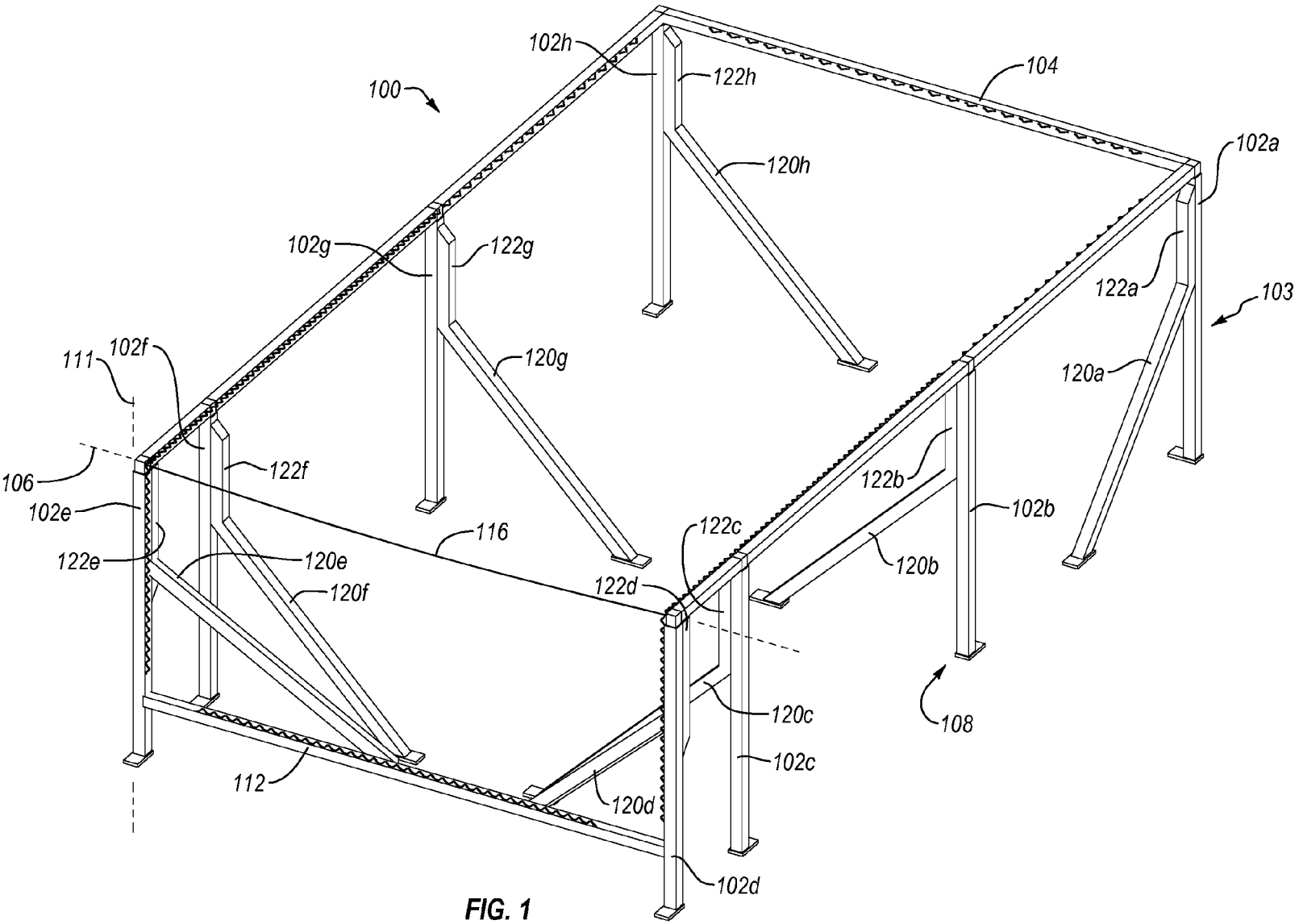
FIG. 1 illustrates a perspective-view of a trampoline frame in accordance with an implementation of the present invention.

The present invention extends to trampolines and trampoline frames configured to support a rebounding mat that extends from a horizontal plane into a vertical plane that is below the horizontal plane. As used herein, the term "trampoline" refers to any rebounding device, whether intended for recreational or competitive use, which provides or is configured to provide a surface on which an individual (or individuals) can jump, bounce, and/or perform other similar motions.

As used herein, the term "rebounding mat" and the like refers to any surface of a trampoline on which an individual (or individuals) can jump, bounce, and perform other similar motions by exerting or creating a force or momentum that is opposed by the surface. Such a surface can comprise any material(s) configured for or capable of receiving or resisting a downward or other directional force or momentum and returning or redirecting the applied force or momentum. A rebounding mat may be made of canvas, webbing, netting, animal hide and/or any other suitable material. The rebounding mat can comprise elastic, flexible, springy and/or stretchy material, but can also comprise inelastic material.

As used herein, the term "plane" refers to any substantially level, even, or flat surface, elevation, or field of dimension regardless of thickness, width, breadth, or other directional measurement. Such a plane may, therefore, encompass a single object or even multiple objects that do not all fall in their entirety on a straight-line. For instance, as used here, a rebounding mat, or portion thereof, may exist in a single plane even though certain forces, including gravity, may cause the rebounding mat or portion thereof to sag, bow, bend, and/or curve. Likewise, a rebounding mat, or portion thereof, may exist in the same plane as a frame, or portion thereof, to which the rebounding mat or portion thereof is connected, even though certain forces, including gravity, may cause the rebounding mat, or portion thereof, as well as the frame, or portion thereof, to sag, bow, bend, and/or curve.

As used herein, the terms "floor" and "floor level" and the like refer to a surface located beneath a rebounding mat, from which a trampoline user is substantially prevented from contacting while standing, sitting, jumping, bouncing, and/or performing other similar motions on the rebounding mat. Such a surface can comprise any solid or liquid material(s) without limitation. Such a floor can be located at a ground level or be located in a recessed position below a ground level.

As used herein, the term "vertical support structure" refers to any suitable object, device, or element configured to support at least a portion of a trampoline frame in a position above a floor. Such a vertical support structure can comprise any suitable material(s). For example, such materials include, but are not limited to, concrete, stone, metal, wood, natural, organic, and/or synthetic material(s), and other suitable material(s). For instance, a vertical support member according to the present invention may comprise steel, iron, or another metal or metal blend or alloy. In certain instances, a vertical support structure may comprise concrete, cement, earth, dirt, stone, soil, and/or other natural and/or manufactured material(s). For example, in cases where a recess provides a floor above or over which a trampoline and/or rebounding mat is placed, a portion of the ground, foundation, slab, earth, and/or other similar area(s) can serve as a vertical support structure.

As used herein, the term "waterfall" refers to a rebounding mat, or a portion of a rebounding mat, that extends from a substantially horizontal plane downward to a substantially vertical plane.

Specifically, with reference to the provided figures and/or drawings, certain implementations of the present invention comprise a frame for a trampoline. A trampoline frame according to the present invention is configured to be connected to a rebounding mat. FIG. 1 illustrates a perspective view of a trampoline frame 100 in accordance with an implementation of the present invention. Trampoline frame 100 comprises a vertical support structure 103 configured to support a first horizontal frame 104 in a first substantially horizontal plane 106 above a floor 108. As shown in FIG. 1, the horizontal frame 104 comprises three sides, each side located in the horizontal plane 106.

As illustrated in FIG. 1, the vertical support structure 103 includes a plurality of vertical support members 102*a-h*. The vertical support members 102*a-h* can comprise a metal or other type of bar or leg, or plurality thereof, on which horizontal frame or horizontal frame element 104 is placed, held, and/or supported in the first substantially horizontal plane 106 above the floor 108. However, a vertical support structure can also comprise an object(s), device(s), or member(s) of other shapes, sizes, and/or compositions. In certain implementations, a vertical support structure can comprise a portion of the ground, foundation, slab, earth, and/or other similar area(s), especially in instances where the floor is positioned and/or located in a recess below ground level. Additionally, the specific number and configuration of vertical support members comprising the vertical support structure may vary depending on the specific application of a particular trampoline (e.g., portable, fixed, recessed, etc.), as conventionally known to those of skill in the art.

FIG. 1 also illustrates how certain implementations of a trampoline or trampoline frame according to the present invention further comprise at least one vertical frame. In FIG. 1, the vertical support members 102*d* and 102*e* are configured to be attached to a rebounding mat (not shown) such that the vertical support member 102*d* functions as a first vertical frame, and vertical support member 102*e* functions as a second vertical frame. The first and second vertical frames of certain implementations of the present invention may be combined with and/or function as the vertical support members 102*d* and 102*e* as shown in FIG. 1, or may be component(s) separate from the vertical support structure and/or member(s). The first and second vertical frames are configured such that when a rebounding mat is attached to the first and second vertical frames, the first and second vertical frames hold a portion of the rebounding mat in a first substantially vertical plane 111 that extends downward from the horizontal frame or 104 and/or the first substantially horizontal plane 106. The present invention contemplates that the vertical frame(s) may comprise a single vertical frame, or any plurality of vertical frames, so long as the vertical frame(s) are configured such that a portion of a rebounding mat is held in a substantially vertical plane extending below the first horizontal plane when the rebounding mat is connected to the vertical frame(s).

In accordance with certain embodiments, trampoline frame 100 can also comprise an optional second horizontal frame element 112 positioned below the horizontal frame 104 and/or the first substantially horizontal plane 106.

As illustrated in FIG. 1, in certain embodiments, the first horizontal frame 104, first and second vertical frames 102*d* and 102*e*, and the second horizontal frame 112 form a closed perimeter to which a rebounding mat (not shown) can be attached. For example, first horizontal frame 104 can be configured to be connected to a first portion of a rebounding mat such that the first portion of the rebounding mat is held in the first substantially horizontal plane 106 when the first portion of the rebounding mat is connected to the first horizontal frame 104. Likewise, the first and second vertical frames 102*d* and 102*e* are configured to be connected to a second portion of the rebounding mat such that the second portion of the rebounding mat is held in the first substantially vertical plane 111 extending downward from the first substantially horizontal plane 106 when the second portion of the rebounding mat is connected to the first and second vertical frames 102*d* and 102*e*.

Certain embodiments of the present invention can also comprise a corner support member 116 configured to extend between two opposing sides of the trampoline or between the first and second vertical frames 102*d* and 102*e* at or near the top thereof. The corner support member 116 of trampoline frame 100 can support the rebounding mat (not shown) near the corner of the rebounding mat formed at the area where the rebounding mat extends from the first substantially horizontal plane 106 to the first substantially vertical plane 111 when the rebounding mat is connected to the first horizontal frame 104 and to the first and second vertical frames 102*d* and 102*e*. Such a corner support member can comprise any material(s) capable of supporting said rebounding mat near said corner, but are sufficiently soft or flexible so as to not present a substantial risk of injury to a jumper should the jumper land on the corner support. Non-limiting examples of suitable material(s) include metal cables, plastic and wood, particularly if such materials are configured to be relative flexible as compared to a frame, and/or include padding thereon. Additional materials may include fabrics, ropes, webbing and/or the like. Such a corner support member can also comprise any configuration capable of supporting said rebounding mat near said corner in manner that does not pose a substantial risk of injury to a jumper landing on the corner support. Non-limiting examples of suitable configurations include a cable, cord, rod, chain, bar, pole, or any other suitable object, device, or element. In a preferred embodiment, the corner support member comprises a flexible and/or elastic material that both supports said rebounding mat near said corner while still allowing the supported rebounding mat to deform or give way under the weight of a jumper landing thereon.

In addition, FIG. 1 illustrates vertical support braces 120*a-h* with a first ends thereof 122*a-h* attached, coupled, and/or connected to a respective vertical support members 102*a-h* such that the vertical support braces 120*a-h* extend from the respective vertical support members 102*a-h* toward and/or in the direction of an opposing vertical support member. In this way, vertical support braces 120*a-h* are configured and positioned to resist movement of a respective vertical support member toward another and/or opposing vertical support member. The present invention contemplates that the vertical support braces may be in any acceptable shape or configuration such that they resist movement of the vertical support member(s) toward one another. Further, the present invention contemplates that any number of vertical support braces may be used, including more than one vertical support brace for any particular vertical support member, and/or no vertical support brace for some or all of the support members.

Figure 2A:
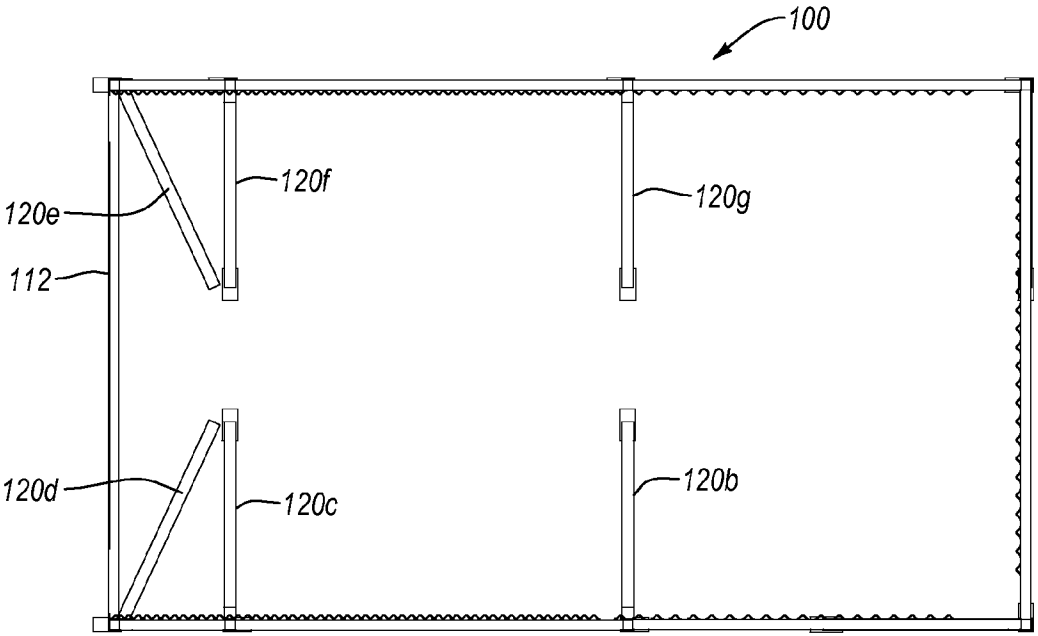
FIG. 2A illustrates a top-view of the trampoline frame of FIG. 1.
Figure 2B:
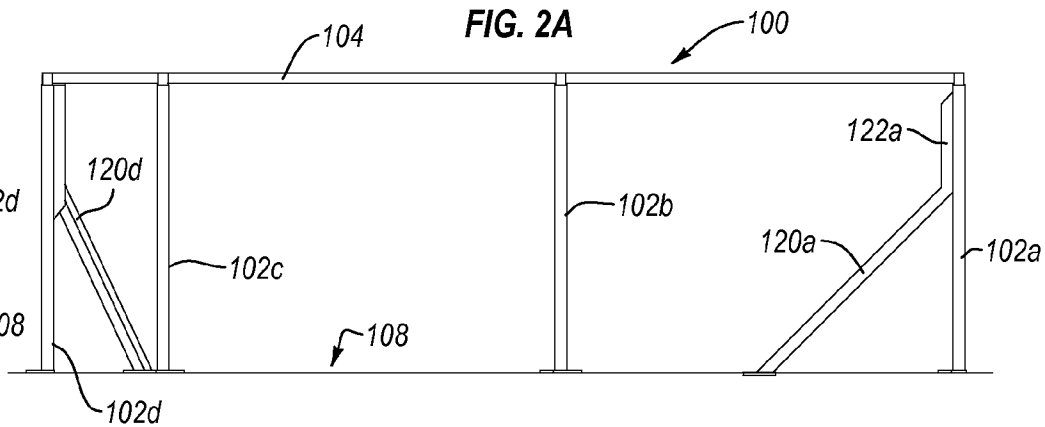
FIG. 2B illustrates a side-view of the trampoline frame of FIG. 1.
Figure 2C:
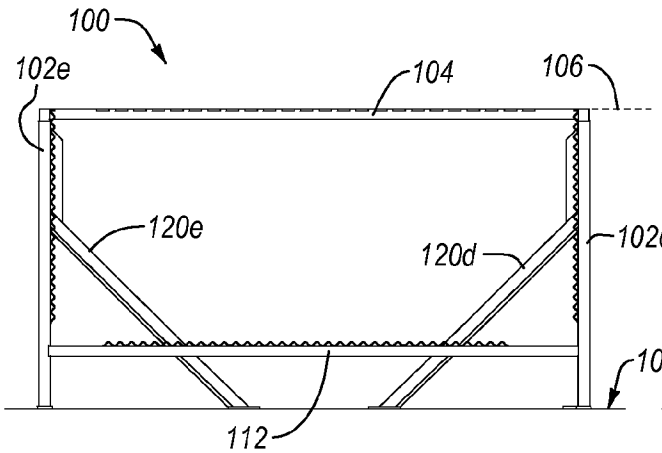
FIG. 2C illustrates a front-view of the trampoline frame of FIG. 1.

FIGS. 2A-2C illustrate a top-view, side-view, and front-view, respectively, of trampoline frame 100 and illustrate the directions that each of the vertical support braces 120*a-g* extend from the respective vertical support members 102*a-g*. For example, vertical support braces 120*b* and 120*g* oppose one another, and each extends toward the other as shown in FIG. 2A. On the other hand, vertical support brace 120*d* and 120*e*, also shown in FIG. 2A, oppose one another, but extend inward toward the center of trampoline frame 104.

Figure 3:
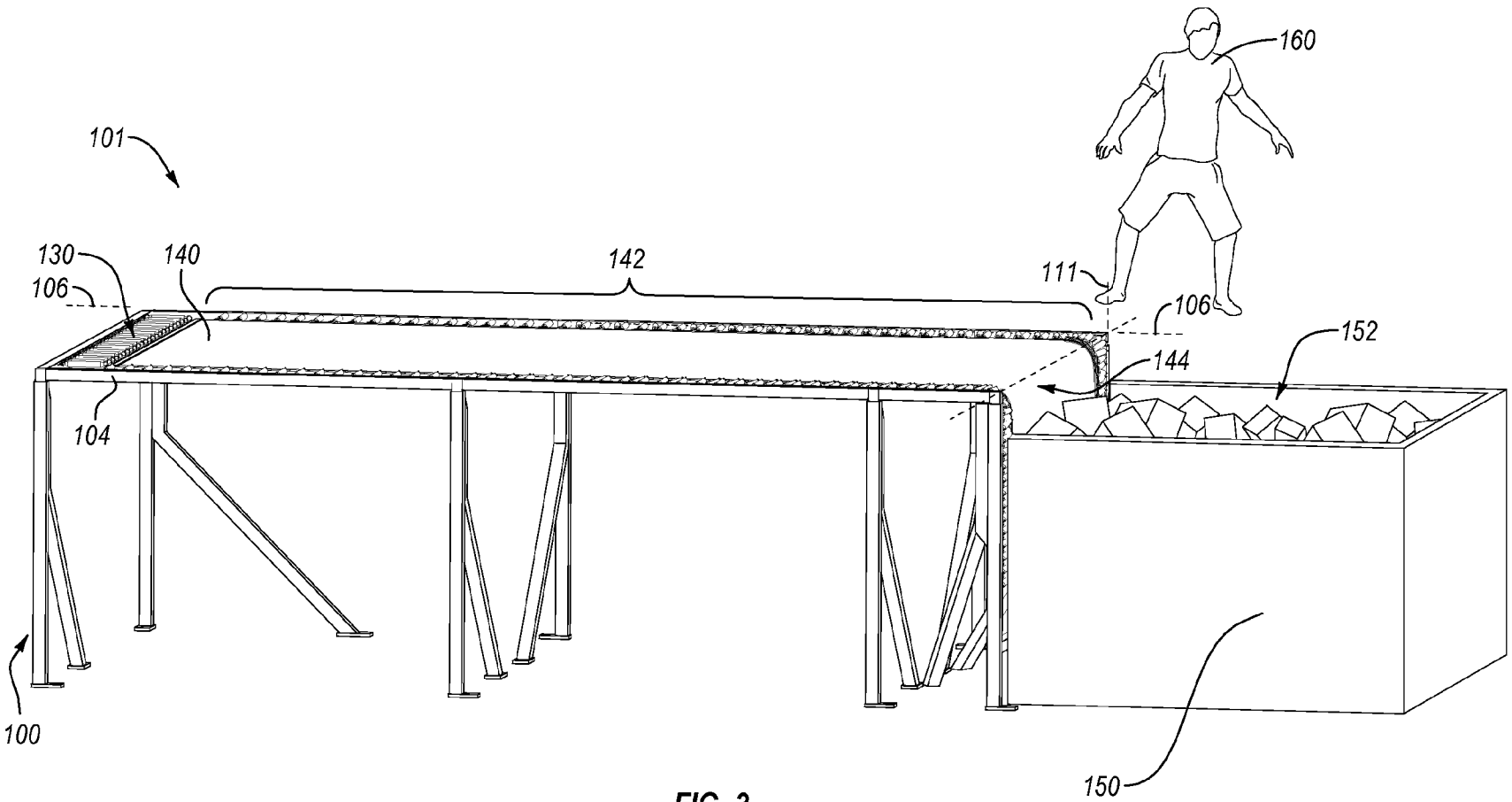
FIG. 3 illustrates a perspective-view of a trampoline in accordance with an implementation of the present invention.

FIG. 3 illustrates a perspective view of the trampoline frame 100 of FIG. 1 assembled in a trampoline 101 for use by a jumper. As shown in FIG. 3, the trampoline 101 includes the trampoline frame 100 and rebounding mat 140. A connecting element 130 connects the rebounding mat 140 to the trampoline frame 100. Specifically, connecting element 130, which is illustrated as a plurality of springs in FIG. 3, connects the first horizontal frame 104 to a first portion 142 of the rebounding mat 140 such that the first portion 142 of the rebounding mat 140 is held in the first substantially horizontal plane 106. Connecting element 130 also connects the first vertical frame 102*d* (FIG. 1) and second vertical frame 102*e* (FIG. 1) to a second portion 144 of the rebounding mat 140 such that the second portion 144 of the rebounding mat 140 is held in the first substantially vertical plane 111, which extends downward from the first horizontal frame 104 and/or the first substantially horizontal plane 106.

In addition to springs, the present invention contemplates a variety of different connectors, connecting elements, and/or means for connecting the trampoline frame 100 to the rebounding mat 140, including one or more tension springs, torsion springs, coil springs, drawbar springs, torsion bars, ropes, elastic chords, webbing, ties, straps, strings, rods, bars, clips, clamps, hooks, rings, pins, and/or any other suitable object(s) that is known or may become known in the art. In one alternative embodiment, the connecting means may comprise the rebounding mat sewn to form a sleeve around a portion of the trampoline frame.

In certain implementations, the portion of the rebounding mat 140 that extends from the first substantially horizontal plane 106 to or into the first substantially vertical plane 111 is reinforced. This reinforcement can comprise an additional layer of rebounding mat material and/or stitching, webbing, patching, and/or other additions configured to reinforce rebounding mat 140 against damage or deformation, including (but not limited to) ripping, tearing, sagging, and any other potential damage or wear that are common to rebounding mats. In addition, reinforcing the rebounding mat 140 can provide additional elasticity, spring, bounce, and/or other functional attributes of rebounding mat 140 and/or trampoline 101.

While trampoline 101 as illustrated in FIG. 3 comprises, substantially, a rectangular shaped design or construction, a trampoline 101, including trampoline frame 100 and rebounding mat or member 140 in accordance with various embodiments of the present invention, can comprise a variety of shapes and sizes. Additional shapes for various implementations of trampoline 101, frame 100, and rebounding mat 140 include circles, ovals, squares, rectangles, hexagons, octagons, and/or other polygonal and/or rounded shapes as are apparent to those of skill in the art. In addition, depending on the shape, trampoline 101, trampoline frame 100, and/or rebounding mat 140 can range in size from about three feet to over 60 feet in length, diameter, or other relevant dimensional measurement.

FIG. 3 also illustrates a foam pit 150 into which individual 160 can jump, bounce, fall, and/or land after dismounting from trampoline 101. Foam pit 150 is illustrative only of a broader class of landing areas that include foam pits, ball pits, water tanks, foam pads, and/or any other suitable landing area. A foam pit 150 can comprise a container and/or recessed area filled with one or more cushions or pads, which can comprise shock or momentum absorbing materials including foam or similar compositions. As illustrated in FIG. 3, foam pit 150 includes a plurality of foam pieces 152 configured to cushion the landing of individual 160 who has jumped toward and/or into foam pit 150. Alternately, a foam pit 150 may simply include a single foam pad or air mattress.

In addition, while foam pit 150 is displayed illustratively as a three-sided and open-top container filled with foam blocks 152, landing areas (including those equivalent to foam pit 150) can comprise any suitable structure, whether above or below the first substantially horizontal plane 106. Therefore, foam pit 150 can comprise a structure, a container, a recess, a hole, a pile, a pad, and/or any other suitable object, device, or element into or onto which an individual 160 can jump, bounce, fall, and/or land after dismounting from trampoline 101. In certain implementations, foam pit 150 can be a multi-sided structure that utilizes at least part of the second portion 144 of rebounding mat 140 to create and/or complete and enclosure into which suitable landing material can be placed, as shown in FIG. 3. This configuration removes the need for a wall or structure of foam pit 150 on the side next to the trampoline 140, thereby decreasing the risk that a jumper may become injured by landing on a wall of the foam pit. Specifically, the second portion 144 of the rebounding mat 140 prevents the foam blocks 152 from spilling out of foam pit 150 underneath the trampoline 140, thereby removing the need for a wall of foam pit 150 on the side of the foam pit that is next to trampoline 140.

FIG. 3 also illustrates how some of the disadvantages of traditional trampolines are overcome by the present invention. One such disadvantage includes the potential for bodily injury caused by coming into contact with the springs, connectors, and/or surface of a trampoline frame when dismounting into or onto a pit. When conventional trampolines are used in connection with a foam pit, the trampoline includes a frame between the rebounding mat and the foam pit. A jumper attempting to jump from the rebounding mat to the foam pit must jump high enough and far enough to clear the trampoline frame and land in the foam pit. Severe injury can result from blunt-force contact with the trampoline frame if jumpers fail to clear the trampoline frame or fall backward into the frame after landing in the foam pit. Although pads can be used to soften a jumper's impact with the trampoline frame and/or springs, such padding has proved insufficient to adequately protect jumpers impacting the frame from injury.

Accordingly, the present invention provides a rebounding mat 140, or portion thereof, to round a corner of the trampoline 101 and extend from the first substantially horizontal plane 106 into the first substantially vertical plane 111, which is below the first substantially horizontal plane 106, thereby eliminating the need for the portion of a conventional trampoline frame that would be located between the rebounding mat and the foam pit. In this way, a jumper and/or trampoline user 160 can dismount trampoline 101 into foam pit 150 without the risk of coming into contact with an intervening portion of the trampoline frame.

In certain implementations, the portion of the rebounding mat 140 that extends from the first substantially horizontal plane 106 to or into the first substantially vertical plane 111 is reinforced. This reinforcement may be accomplished by attaching webbing, a second rebounding mat (or portion thereof) and/or some other material to the portion of the rebounding mat to be reinforced.

Figure 4:
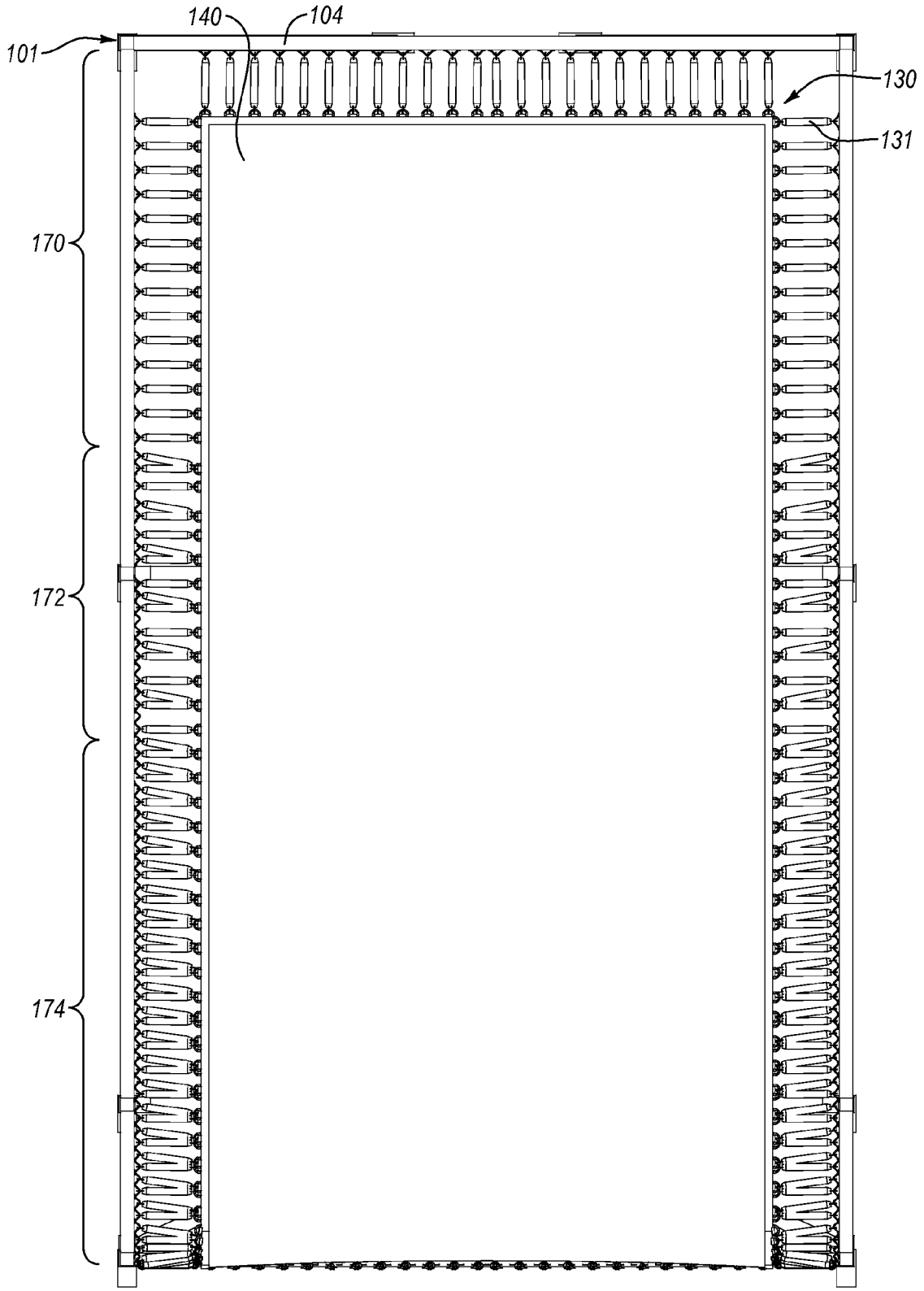
FIG. 4 illustrates a top-view of the trampoline of FIG. 3.

FIG. 4 illustrated a top-view of the trampoline 101 of FIG. 3, wherein rebounding mat 140 is suspended from the frame 100 by connecting element 130. According to the embodiment illustrated in FIG. 4, connecting element 130 comprise a plurality of springs 131. In certain implementations, the rebounding mat need not be connected to the frame by elastic, springy, or rebounding connecting element(s) and/or material(s). In some instances, an elastic character of the rebounding mat 140 itself, or material(s) from or with which the rebounding mat 140 is comprised, provides some or all of the rebounding properties of the trampoline 101 and/or rebounding mat 140. In other embodiments, the connectors, element(s) or object(s) used to connect, and/or means for connecting the rebounding mat to the trampoline frame provides some or all of the rebounding properties of the trampoline 101. In the embodiment illustrated in FIG. 4, the number of springs 131 comprising connecting element 130, as well as the stiffness or spring constant or co-efficient of the springs 131 contributes to the amount of resistance and recoil the trampoline 101 can provide. The resistance, in turn, contributes to the maximum height an individual can (safely) jump or bounce on the trampoline 101.

FIG. 4 also illustrates how the number and positioning of springs 131 that comprise connecting element 130 can effectively support rebounding mat 140. In one embodiment of the present invention, the density of springs 131 is higher near the portion of rebounding mat 140 that extends and/or transitions from the first horizontal plane 106 to the first vertical plane 111. Specifically, FIG. 4 illustrates a first section 170 of connecting element 130 having a first density of springs 131, a second section 172 of connecting element 130 having a second density of springs 131 that is higher than the density of springs 131 in the first section 170, and a third section 174 of connecting element 130 having a third density of springs 131 that is higher than the density of springs 131 in the second section 172. This progressive increase in the density of springs 131 provides increased tension to rebounding mat 140 at or near the portion of rebounding mat 140 that extends and/or transitions from the first horizontal plane 106 to the first vertical plane 111. In this embodiment, this increase in tension on or to the rebounding mat 140 at or near the portion of rebounding mat 140 that transitions from the first horizontal plane 106 to the first vertical plane 111 holds that portion of the rebounding mat 140 sufficiently taught.

Persons of skill in the art will appreciate that other conventional methods for varying the tension applied to rebounding mat may be employed, including the use of springs having different spring constants, varying the method of attaching the springs, and/or varying the density of the springs. Persons of skill in the art will appreciate that similar principles may be employed to vary the tension applied to different portions of the rebounding mat using torsion springs, coil springs, drawbar springs, torsion bars, ropes, elastic chords, webbing, ties, straps, strings, rods, bars, clips, clamps, hooks, rings, pins, or any other suitable attachment.

Figure 5:
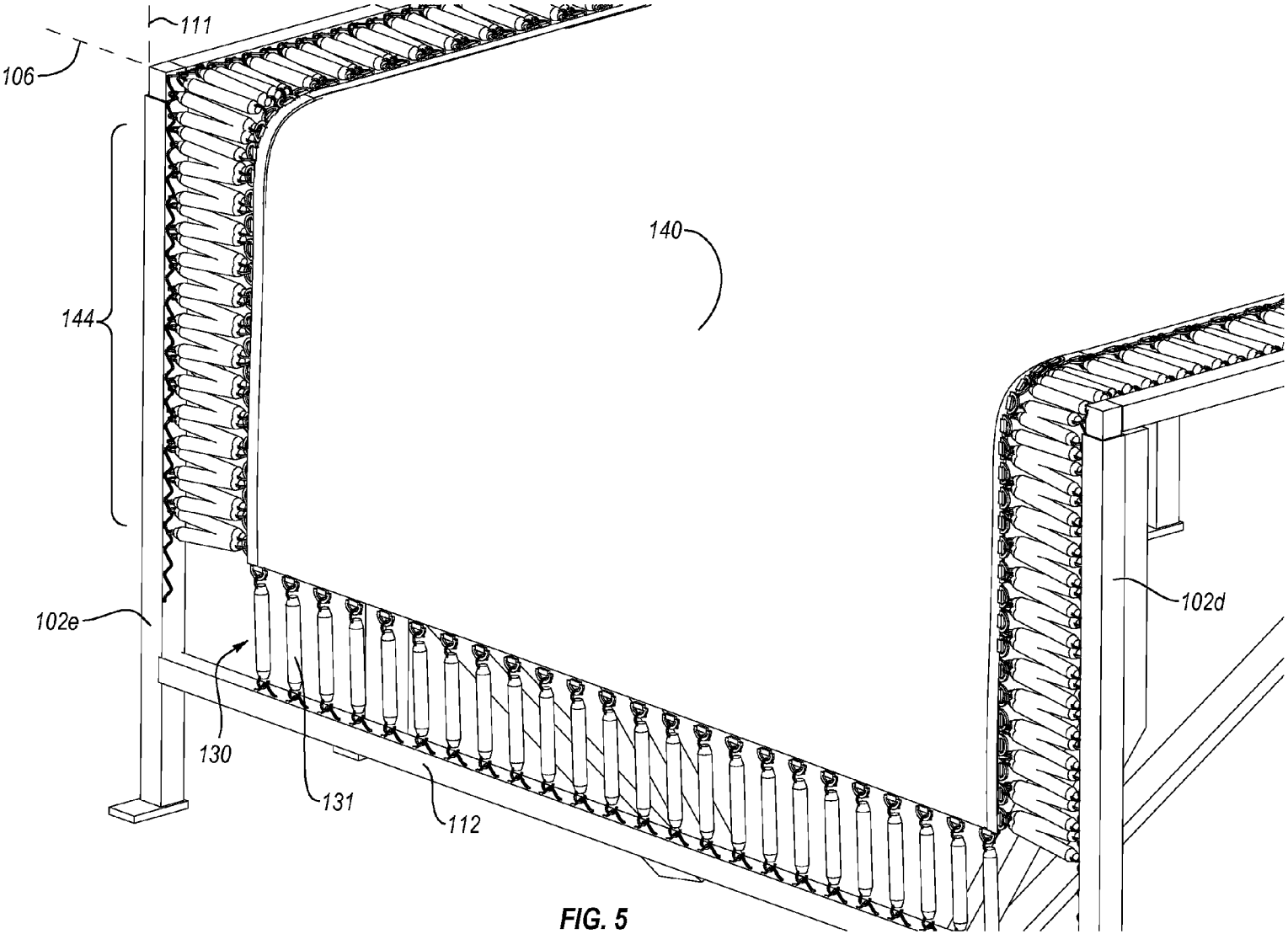
FIG. 5 illustrates a perspective-view of a front portion of the trampoline of FIG. 3.

FIG. 5 illustrates a perspective-view of the front of the trampoline 101 of FIG. 3. As shown in FIG. 5, the second portion 144 of rebounding mat 140 is positioned in the first vertical plane 111. Specifically, the multiple springs 131 of connecting element 130 attach the second portion 144 of the rebounding mat 140 to the first vertical frame 102*d*, the second vertical frame 102*e*, and the second horizontal frame 112. In one embodiment, the density of springs 131 attaching the second portion 144 of rebounding mat 140 to the first and second vertical frames, 102*d* and 102*e* respectively, is the same as the density of springs 131 in the third section 174 of springs shown in FIG. 4.

In another embodiment, the trampoline 101 does not include the second horizontal frame 112, and the bottom edge of the second portion 144 of rebounding mat 140 is free-hanging (not shown). In this embodiment the second portion 144 of rebounding mat 140 is attached to the first and second vertical frames, 102*d* and 102*e* respectively, such that the force exerted on the second portion 144 of the rebounding mat 140 includes a substantial downward component. For example, rather than attaching the springs 131 substantially perpendicular to the first and second vertical frames 102*d* and 102*e* and rebounding mat 140 as shown in FIG. 5, the springs 131 may be attached at an angle (not shown) so as to provide a substantial downward pull or force on the portion of the rebounding mat 140 located in the first vertical plane 111.

In another embodiment of the present invention, the second horizontal frame 112 of FIG. 5 may be further configured to attach to a second rebounding mat (not shown) that is held in a second horizontal plane by a second trampoline frame (not shown). This second rebounding mat (not shown) may be used to hold foam blocks, balls or the like in the foam pit 150 (FIG. 3), or may be used as a second rebounding surface located in a horizontal plane below the first horizontal plane 106, or both.

In another embodiment, the trampoline may include a "waterfall" on more than one side of the trampoline. For example, referring to FIG. 4, in addition to the "waterfall" formed by the second portion 144 of the rebounding mat 140, trampoline 101 could include a similar "waterfall" on the opposing side of trampoline 101. Accordingly, a trampoline or trampoline frame according to certain implementations of the present invention may further comprise a second set of vertical frames (not shown) configured to be connected to a third portion (not shown) of the rebounding mat 140 such that the third portion (not shown) of the rebounding mat 140 is held in a second substantially vertical plane (not shown) extending downward from the first substantially horizontal plane 106. Those of skill in the art will appreciate that a trampoline according to certain embodiments of the present invention may be shaped and configured to include any number of "waterfalls." Such configurations may comprise multiple vertical frames in, potentially, multiple substantially vertical planes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A frame for a trampoline, the frame comprising:

a first horizontal frame configured to be connected to a first portion of a rebounding mat such that the first portion of the rebounding mat is held in a first substantially horizontal plane when the first portion of the rebounding mat is connected to the first horizontal frame; and a first vertical frame configured to be connected to a second portion of the rebounding mat such that the second portion of the rebounding mat is held in a first substantially vertical plane extending downward from the first substantially horizontal plane when the second portion of the rebounding mat is connected to the first vertical frame.

2. The trampoline frame of claim 1, further comprising a second horizontal frame configured to be connected to a bottom edge of the second portion of the rebounding mat.

3. The trampoline frame of claim 2, wherein the frame forms a closed perimeter configured to attach to each edge of the rebounding mat.

4. The trampoline frame of claim 1, further comprising a vertical support structure configured to support the first horizontal frame in the first substantially horizontal plane above a floor.

5. The trampoline frame of claim 1, further comprising a corner support member configured to extend between two opposing sides of the trampoline frame such that the corner support member supports the rebounding mat near a corner of the rebounding mat formed at an area where the rebounding mat extends from the first substantially horizontal plane to the first substantially vertical plane when the rebounding mat is connected to the first horizontal frame and to the first vertical frame.

6. The trampoline frame of claim 1 further comprising:

at least one vertical support brace;

wherein the at least one vertical support structure comprises at least a first vertical support member and a second vertical support member, wherein the first vertical support member is positioned opposite the second vertical support member; and wherein a first end of the at least one vertical support brace is attached to the first vertical support member such that the at least one vertical support brace extends from the first vertical support member in the direction of the opposing second vertical support member, and wherein the at least one vertical support brace resists movement of the first vertical support member toward the opposing second vertical support member.

7. A trampoline comprising:

a rebounding mat connected to a frame, wherein the frame comprises:

a first horizontal frame configured to be connected to a first portion of the rebounding mat such that the first portion of the rebounding mat is held in a first substantially horizontal plane when the first portion of the rebounding mat is connected to the first horizontal frame; and a first vertical frame configured to be connected to a second portion of the rebounding mat such that the second portion of the rebounding mat is held in a first substantially vertical plane, the second portion of the rebounding mat extending downward from the first substantially horizontal plane when the second portion of the rebounding mat is connected to the first vertical frame such that rebounding mat forms a first waterfall.

8. The trampoline of claim 7, further comprising at least one connecting element, wherein the at least one connecting element connects the rebounding mat to the frame.

9. The trampoline of claim 8, wherein the at least one connecting element exerts more tension on the rebounding mat at a portion of the rebounding mat that extends from the first substantially horizontal plane to the first substantially vertical plane than at a portion of the rebounding mat located in the first substantially horizontal plane.

10. The trampoline of claim 9, wherein the at least one connecting element comprises a plurality of springs.

11. The trampoline of claim 10, wherein the more tension exerted on the rebounding mat at a portion of the rebounding mat that extends from the first substantially horizontal plane to the first substantially vertical plane is the result of an increase in the number of springs per linear foot connecting the frame to the portion of the rebounding mat that extends from the first substantially horizontal plane to the first substantially vertical plane than the number of springs per linear foot connecting the frame to the portion of the rebounding mat located in the first substantially horizontal plane.

12. The trampoline of claim 10, wherein the more tension exerted on the rebounding mat at a portion of the rebounding mat that extends from the first substantially horizontal plane to the first substantially vertical plane is the result of a higher spring constant of at least one spring connecting the frame to the portion of the rebounding mat that extends from the first substantially horizontal plane to the first substantially vertical plane than a spring constant of at least one spring connecting the frame to the portion of the rebounding mat located in the first substantially horizontal plane.

13. The trampoline of claim 10, wherein at least one of the plurality of springs is used to connect the second portion of the rebounding mat to the first vertical frame such that the at least one of the plurality of springs exerts a downward force on the second portion of the rebounding mat.

14. The trampoline of claim 8, wherein the at least one connecting element comprises at least one elastic chord.

15. The trampoline of claim 7, wherein the frame further comprises a second horizontal frame configured to be connected to a bottom edge of the second portion of the rebounding mat.

16. The trampoline of claim 15, wherein the frame forms a closed perimeter configured to connect to each edge of the rebounding mat.

17. The trampoline of claim 15, wherein the second horizontal frame is configured to be connected to a first portion of a second rebounding mat such that the first portion of the second rebounding mat is held in a second substantially horizontal plane that is below the first substantially horizontal plane.

18. The trampoline of claim 7, wherein the frame further comprises a second vertical frame configured to be connected to a third portion of the rebounding mat such that the third portion of the rebounding mat is held in a second substantially vertical plane extending downward from the first substantially horizontal plane such that rebounding mat forms a second waterfall.

19. The trampoline of claim 7, wherein a portion of the rebounding mat that extends from the first substantially horizontal plane to the first substantially vertical plane is reinforced.

20. The trampoline of claim 7, further comprising a vertical support structure configured to support the first horizontal frame in the first substantially horizontal plane above a floor.

21. The trampoline of claim 7, further comprising a corner support member configured to extend between two opposing sides of the frame such that the corner support member supports the rebounding mat near a corner of the rebounding mat formed at an area where the rebounding mat extends from the first substantially horizontal plane to the first substantially vertical plane when the rebounding mat is connected to the first horizontal frame and to the first vertical frame.

22. A trampoline comprising:

a rebounding mat connected to a frame, wherein the frame comprises:

a first horizontal frame configured to be connected to a first portion of the rebounding mat such that the first portion of the rebounding mat is held in a first substantially horizontal plane when the first portion of the rebounding mat is connected to the first horizontal frame; and a first vertical frame configured to be connected to a second portion of the rebounding mat such that the second portion of the rebounding mat is held in a first substantially vertical plane extending downward from the first substantially horizontal plane when the second portion of the rebounding mat is connected to the first vertical frame; and means for connecting the rebounding mat to the frame.

23. The trampoline of claim 22, wherein the means for connecting the rebounding mat to the frame exerts more tension on the rebounding mat at a portion of the rebounding mat that extends from the first substantially horizontal plane to the first substantially vertical plane than at a portion of the rebounding mat located in the first substantially horizontal plane.

* * * * *